United States Patent [19]

Stieler

[11] 4,440,217

[45] Apr. 3, 1984

[54] COUNTERFLOW HEAT EXCHANGER

[76] Inventor: Scott M. Stieler, 3114 Fenner #10, Marlette, Mich. 48453

[21] Appl. No.: 386,936

[22] Filed: Jun. 10, 1982

[51] Int. Cl.[3] ..... F28D 7/10; F28F 9/22

[52] U.S. Cl. ..... 165/155; 165/143; 165/145

[58] Field of Search ..... 165/155, 143, 145

[56] References Cited

U.S. PATENT DOCUMENTS

| | | | |
|---|---|---|---|
| 145,095 | 12/1873 | Coughlin . | |
| 479,271 | 7/1892 | Grohman . | |
| 894,141 | 7/1908 | Herman . | |
| 1,554,654 | 9/1925 | Priser | 165/155 |
| 1,597,618 | 8/1926 | Priser . | |
| 1,967,837 | 7/1934 | Naab . | |
| 2,526,526 | 10/1950 | Yuza | 165/155 |
| 2,633,338 | 3/1953 | Hiersch | 165/143 |
| 4,232,735 | 11/1980 | Kim et al. | 165/183 |
| 4,254,826 | 3/1981 | Adams | 165/143 |

FOREIGN PATENT DOCUMENTS

| | | | |
|---|---|---|---|
| 37440 | 4/1886 | Fed. Rep. of Germany | 165/155 |
| 465490 | 5/1937 | United Kingdom | 165/155 |

*Primary Examiner*—Sheldon J. Richter

*Attorney, Agent, or Firm*—Basile, Weintraub & Hanlon

[57] ABSTRACT

A heat exchanger for exchanging heat between two different temperature fluids. The heat exchanger includes a sealed housing having first and second pairs of inlets and outlets. A first conduit is disposed within the housing. A second conduit is concentrically disposed within and spaced from the first conduit to define a first flow path between the spaced wall surfaces thereof which is disposed in fluid flow communication with the first inlet and first outlet for flow of a first fluid in a first direction through the housing. A second fluid flow path including first and second serially connected sections is provided for directing a second fluid between the second inlet and the second outlet over the exterior wall surface of the first conduit and through the second conduit in a second direction opposite to the direction of flow of the first fluid. In a preferred embodiment, a sealed chamber is formed interiorly within the housing about the first conduit. A third inlet and a third outlet are formed in the housing and are interconnected in a fluid flow communication by a third conduit preferably disposed exteriorly from the housing. The second and third inlets are disposed in fluid flow communication with the sealed chamber at opposite ends thereof to define the first section of the second flow path for the second fluid through the housing. The third outlet is disposed in fluid flow communication with one end of the second conduit such that the second fluid flowing through the sealed chamber in a second direction opposite to the direction of the fluid flow of the first fluid will be directed through the second conduit in the same second direction opposite the direction of flow of the first fluid. Alternately, a plurality of pairs of concentric first and second conduits are mounted in a spaced apart manner within the interior of the housing.

5 Claims, 4 Drawing Figures

COUNTERFLOW HEAT EXCHANGER

BACKGROUND OF THE INVENTION

1. Field of the Invention

This invention relates, in general, to heat exchangers.

2. Description of the Prior Art

Heat exchangers have long been used to exchange or transfer heat from one fluid to another so as to cause heating or cooling of one of the fluids. Such heat exchangers find wide spread use in coolers, air conditioners, water heaters, etc.

Such heat exchangers operate on the principle of heat transfer through the wall of a conduit from a higher temperature fluid flowing on one side of the conduit wall to a lower temperature fluid flowing on the other side of the conduit wall wherein the higher temperature fluid gives up a portion of its heat to the lower temperature fluid as it flows along the conduit wall. As it is known that heat transfer capability can be increased by exposing a larger heat transfer surface to the flow of the high and low temperature fluids and, also, by utilizing small cross sectional areas of fluid flow which is directly exposed to the heat transfer surface, heat exchangers having concentric tubes or conduits have been developed. In such a heat exchanger, one fluid flows through the inner conduit, with the other fluid flowing through the annular space between the inner and outer conduits, preferably in a counter direction to the first fluid. One or more of such concentrically disposed tube pairs are employed, depending upon the required capacity of the heat exchanger.

It has also been known to incorporate various manifolds and ports within a heat exchanger in order to direct the inner tube fluid flow out of the inner tube and back over a portion of the outer tube to increase the amount of heat transfer surface between the fluids. However, such previously devised heat exchangers offer less than maximum heat transfer capability which detracts from their advantageous use and requires a larger size or capacity heat exchanger in order to obtain a given heat transfer rate.

A major factor in the low efficiency of such previously devised heat exchangers is the occurrence of laminar flow at the heat transfer surface which results in the buildup of a stagnant film barrier. In order to prevent the occurrence of the stagnant film barrier within a heat exchanger, previously devised heat exchangers utilize a variety of turbulence inducing means in order to create turbulent flow of the fluids within the heat exchanger. Such means obviously increase the cost of the heat exchanger and have, to date, done little to improve overall efficiency of such heat exchangers.

Thus, it would be desirable to provide a heat exchanger which overcomes the problems of previously devised heat exchangers relating to less than maximum heat transfer rates. It would also be desirable to provide a heat exchanger which is constructed with relatively inexpensive, readily available components for a low manufacturing cost. It would also be desirable to provide a heat exchanger which can be easily constructed in a variety of sizes. Finally, it would be desirable to provide a heat exchanger which can be used for a variety of applications and for either heating or cooling.

SUMMARY OF THE INVENTION

There is disclosed herein a unique heat exchanger for exchanging heat between a higher temperature fluid and a lower temperature fluid. The heat exchanger includes a sealed housing having first and second pairs of inlets and outlets. A first conduit is concentrically disposed within the housing. A second conduit is concentrically disposed within and spaced from the inner wall surface of the first conduit to define a first flow path bewteen the spaced wall surfaces of the first and second conduits. The first flow path is disposed in fluid flow communication with the first inlet and first outlet for the flow of the first fluid in a first direction through the housing.

Means are provided for forming a second flow path between the second inlet and second outlet in the housing. The second flow path includes first and second serially connected sections for directing the second fluid between the second inlet and second outlet serially over the outer surface of the first conduit and through the second conduit in a second direction opposed to the flow direction of the first fluid through the first flow path.

In a preferred embodiment, the means for forming the second flow path comprises a first chamber formed within the housing by spaced wall members secured to the interior of the housing and having co-axial apertures formed therein which receive the first conduit therethrough. A third inlet and a third outlet are formed in the housing and are connected in fluid flow communication by means of a third conduit preferably disposed externally from the housing. The second and third inlets are situated in the housing so as to direct the flow of the second fluid across the exterior surface of the first conduit in a second direction between the first and second conduits opposite from the direction of flow of the first fluid through the first fluid flow path. The second fluid is directed by means of the third conduit from the first chamber through the second conduit, again, in a second direction opposite from the direction of flow of the first fluid through the first flow path. In this manner, the fluid flow of the second fluid is always opposite or counter the direction of flow of the first fluid through the housing for maximum heat transfer efficiency.

In an alternate embodiment, a plurality of pairs of concentrically arranged first and second conduits are disposed within the housing for increased heat transfer capability.

The heat exchanger of the present invention overcomes many of the problems existing with previously devised heat exchangers in that it provides a highly efficient heat transfer rate. This high heat transfer rate is achieved by preventing the occurrence of laminar flow within the heat exchanger which previously resulted in the buildup of a stagnant film barrier which adversely affects heat transfer between the different temperature fluids on opposite sides of the heat transfer surface.

Furthermore, both sides of the flow path carrying the first fluid is exposed to the flow of the second temperature fluid in a counter or opposite direction which thereby increases the amount of active heat transfer surface. In addition, the serial construction of the second flow path substantially increases the amount of time the two fluids are disposed in a heat transfer relationship which improves the overall efficiency of the present heat exchanger.

The heat exchanger of the present invention is constructed of relatively inexpensive, readily available components which results in a low manufacturing cost. Furthermore, the heat exchanger of the present invention may be readily adapted to a variety of applications, including both heating and cooling, as well as varied in size as necessary to achieve any desired heat exchange rate.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
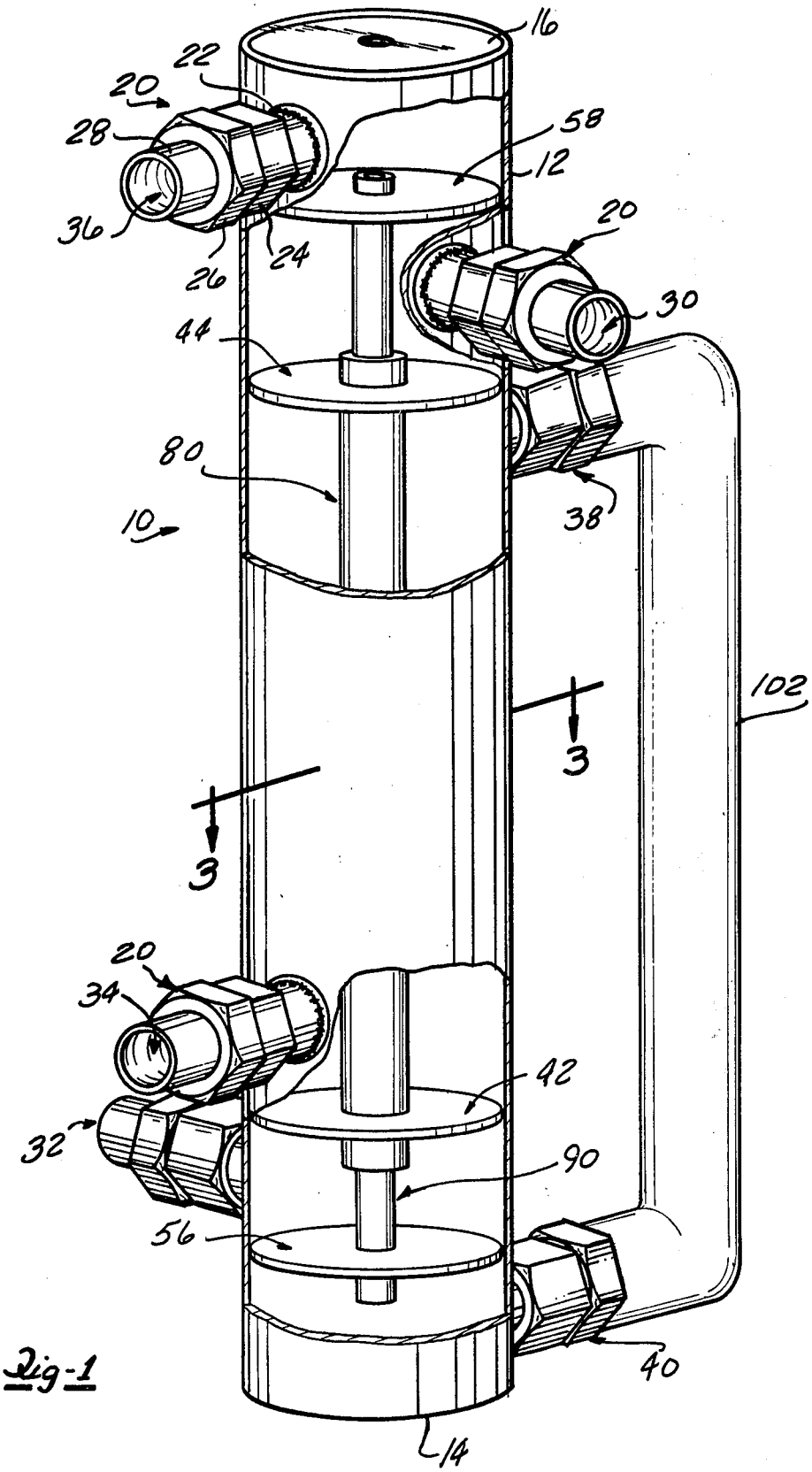
FIG. 1 is a perspective view of a heat exchanger constructed in accordance with the teachings of the present invention.

Throughout the following description and drawing, identical reference numbers are used to refer to the same component shown in multiple figures of the drawing.

Referring now to the drawing, there is illustrated a heat exchanger 10 which is operative to exchange heat between two different temperature fluids, such as water, oils, refrigerants, exhaust air, etc.

Figure 2:
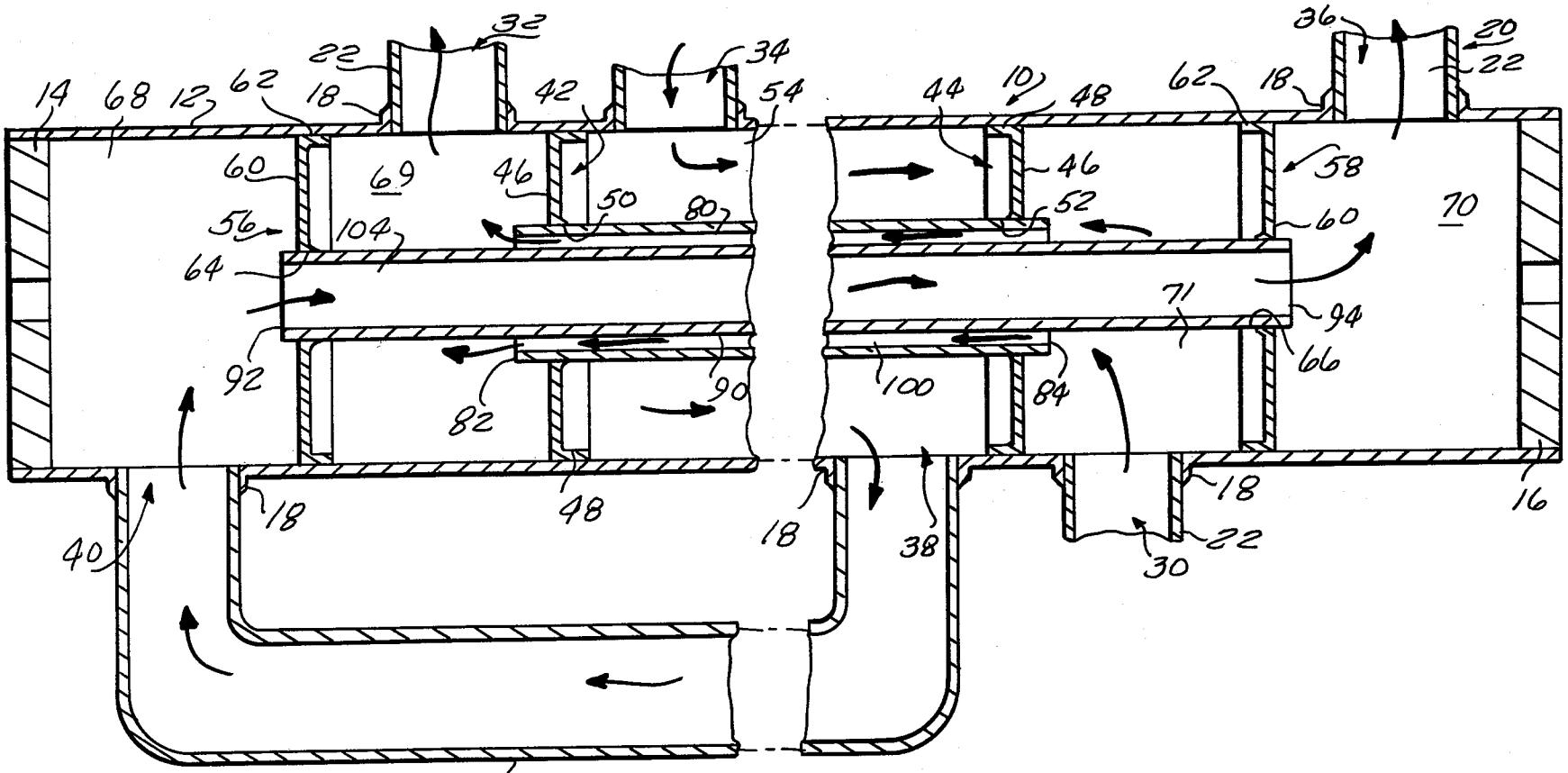
FIG. 2 is a longitudinal cross sectional view of the heat exchanger shown in FIG. 1 with the position of certain of the inlets and outlets being altered in order to more clearly illustrate the flow paths therebetween.
Figure 3:
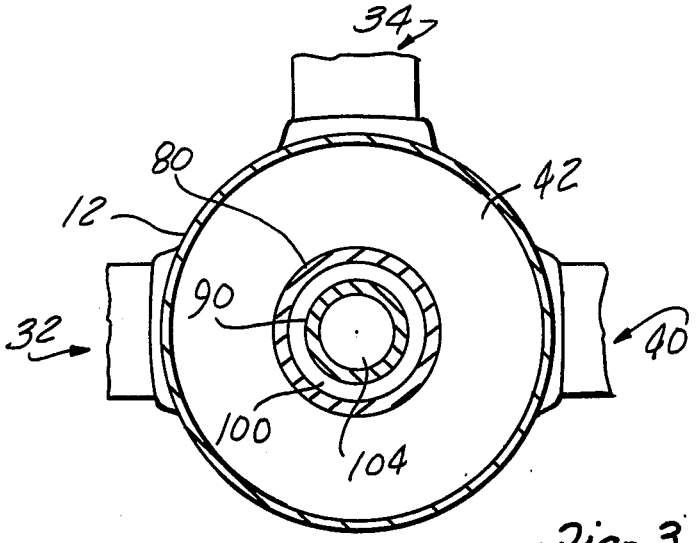
FIG. 3 is a cross sectional view, generally taken along line 3—3 in FIG. 1.

As shown in FIGS 1, 2 and 3, the heat exchanger 10 comprises a sealed housing 12 in the form of a hollow, tubular member, preferably having a cylindrical configuration. A pair of end caps 14 and 16 are sealingly disposed at opposed ends of the housing 12 to provide a sealed, water interior for the housing 12.

The housing 12 is further provided with a plurality of ports 18 which are formed in the side wall of the housing 12. As shown more clearly in FIG. 2, each of the ports 18 is provided with an outwardly extending annular collar which is adapted to receive a suitable water tight fitting or connection, shown generally by reference number 20 in FIG. 1.

By way of example, and not limitation, a typical fitting 20 comprises a short length of hollow conduit 22 which is brazed or otherwise secured to the annular collar of each port 18 in the housing 12. A first externally threaded member or union 24 is in turn brazed to the outer end of the short length conduit 22 and is adapted to threadingly receive a second internally threaded member or union 26. The second member 26 is adapted to receive one end of an external conduit, such as conduit 28, to which the heat exchanger 10 is to be connected. The short length conduit 22 and the threaded unions 24 and 26 cooperate to provide a means for connecting an external conduit, such as conduit 28, to any of the ports 18 of the housing 12.

As shown more clearly in FIG. 2, the ports 18 formed in the housing 12 function as cooperating pairs of inlets and outlets for fluid flow through various flow paths within the heat exchanger 10 of the present invention. According to a preferred embodiment, a first inlet 30, a first outlet 32, a second inlet 34, a second outlet 36, a third inlet 38 and a third outlet 40 are provided on the housing 12.

The ports 18 forming the first, second and third pairs of inlets and outlets are arranged about the surface of the housing 12 to provide a convenient connection to the apparatus to which the heat exchanger 10 is to be connected. Thus, in a preferred embodiment, the second inlet 34 and the second outlet 36 are aligned along one side of the heat exchanger 10, the third inlet 38 and the third outlet 40 are aligned on an opposite side of the housing 12 and the first inlet 30 and the first outlet 32 are disposed on opposite sides of the housing 12, as shown in FIG. 1.

As shown in FIGS. 2 and 3, a first pair of wall members or collars 42 and 44 are disposed in a spaced apart manner within the interior of the housing 12. Each of the first pair of collars 42 and 44 includes an end wall 46, an outer annular flange 48 which is secured in a sealed manner to the side wall of the housing 12 and a centrally located aperture, such as apertures 50 and 52, respectively. The first pair of wall members 42 and 44 cooperate to define a sealed chamber 54 therebetween, the purpose of which will be described in greater detail hereafter.

A second pair of wall members or collars 56 and 58, each including an end wall 60, an annular flange 62 and a centrally located aperture, such as apertures 64 and 66, respectively, are disposed in a spaced apart manner within the interior of the housing 12 between the first pair of wall members 42 and 44 and the end walls 14 and 16, respectively. The second pair of wall members 56 and 58 cooperate with the end walls 14 and 16, respectively, to define second and third end chambers 68 and 70, respectively, the purposes of which will be described in greater detail hereafter. Further, fourth and fifth chambers 69 and 71, respectively, are formed between the wall members 42 and 56, and 44 and 58, respectively.

A first fluid flow conduit 80 is concentrically disposed within the interior of the housing 12 of the heat exchanger 10 of the present invention and is supported by the co-axially aligned apertures 50 and 52 of the wall members 42 and 44, respectively, with the ends 82 and 84 thereof extending outward beyond the wall members 42 and 44, respectively, into the chambers 69 and 71. The first conduit 80 is preferably of circular cross section and is brazed or otherwise secured in a fluid-tight manner to the wall members 42 and 44.

A second fluid flow conduit 90 is concentrically disposed within and spaced from the inner wall surface of the first conduit 80. The second conduit 90 is of longer length then the first conduit 80 and its first and second ends 92 and 94, respectively, extending outward beyond the wall members 56 and 58 into the chambers 68 and 70. The second conduit 90 is brazed or otherwise secured to the wall members 56 and 58 in a fluid-tight arrangement.

The first and second conduits 80 and 90 form a first axially extending flow path 100 between the wall surfaces thereof. The first flow path 100 is disposed in fluid flow communication with the first inlet 30 and the first outlet 32 and defines a fluid flow path for the first fluid in a first direction through the housing 12 between the first inlet 30 and the first outlet 32, as shown by the arrows in FIG. 2.

The heat exchanger 10 of the present invention further includes means for forming a second flow path for the second fluid between the second inlet 34 and the second outlet 36 for fluid flow of the second fluid through the housing 12 in a second direction opposed or counter to the direction of flow of the first fluid through the housing 12. Preferably, the second flow path includes first and second serially connected portions or sections. The first portion is defined by first means, disposed in the housing 12, for directing flow of the second fluid across the exterior surface of the side wall of the first conduit 80. The first means is formed by the first sealed chamber 54 around the side wall of the housing 12, the exterior surface of the first conduit 80 and the wall members 42 and 44 such that the second fluid entering the second inlet 34 will be directed across the exterior side wall surface of the first conduit 80 between the wall members 42 and 44.

The second portion of the second flow path is formed by second means for directing flow of the second fluid from the first flow directing means to one end of the second conduit 90.

The second flow directing means includes the third inlet 38, the third outlet 40 and a third fluid flow conduit 102. Preferably, the third conduit 102, whidh is of circular cross section and disposed in fluid flow communication between the third inlet 38 and the third outlet 40, is disposed exteriorly from the housing 12.

As shown in FIG. 2, the second inlet 34 and the third inlet 38 are disposed in fluid flow communication at opposite ends of the first chamber 54 such that the second fluid flowing therethrough will be directed in a second direction across the exterior surface of the side wall of the first conduit 80; which flow direction is opposite or counter to the direction of the first fluid flow through the first flow path 100 between the first and second conduits 80 and 90, as shown by the arrows in FIG. 2.

Further, as shown in FIG. 2, the third outlet 40 is disposed in fluid flow communication with the second end chamber 68 in the housing 12. In this manner, the second fluid flow exiting the first sealed chamber 54 through the third inlet 38 will flow in the direction of the arrows through the third conduit 102, the second end chamber 68, through the end 92 of the second conduit 90 and through the interior of the second conduit 90. While flowing through the second conduit 90, the second fluid is flowing in a second direction opposite to the direction of flow of the first fluid through the first flow path 100. In this manner, the first fluid flowing through the first flow path 100 is exposed to second fluid flow on both sides thereof in a second or counter direction for maximum heat transfer between the first and second fluids.

Finally, the second end 94 of the second conduit 90 is disposed within the third end chamber 70 which is in turn disposed in fluid flow communication with the second outlet 36 to complete the second flow path 104.

In constructing the heat exchanger 10 of the present invention, the housing 12, conduits 80, 90 and 102 and the annular collars 42, 44, 56 and 58 are formed of copper for maximum heat transfer capability and are preferably formed with thin walls. The cross-sectional diameters of the first and second conduits 80 and 90 as well as the interior diameter of the housing 12 may be formed in a variety of sizes depending upon the heat exchange capacity required as well as the viscosity of the fluids which are to be utilized. Thus, for example, higher viscosity fluids, such as oils, will require a large annular space for the first flow path 100 between the first and second conduits 80 and 90 which can be implemented by increasing the difference between the respective diameters of the first and second conduits 80 and 90.

Figure 4:
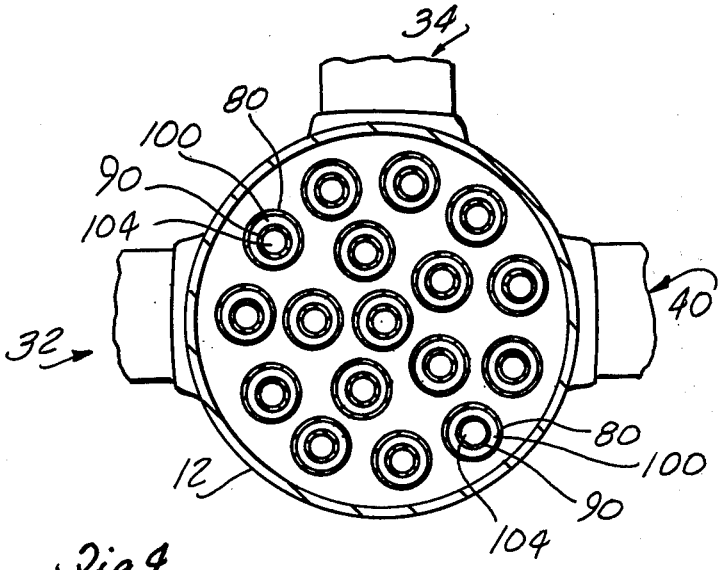
FIG. 4 is a cross sectional view, similar to that shown in FIG. 3, but depicting an alternate embodiment of the heat exchanger of the present invention.

In an alternate embodiment of the heat exchanger 10 of the present invention shown in FIG. 4, a plurality of pairs of concentrically arranged first and second conduits 80 and 90 are supported in a spaced apart manner within the interior of the housing 12. The pairs of wall members which respectively support the ends of the first and second conduits 80 and 90 are suitably formed with a plurality of co-axially aligned apertures for receiving and supporting the ends of the first and second conduits 80 and 90. The first and second flow paths 100 and 104, described above, are the same for this embodiment of the present invention such that the first fluid flow through the axial passages between the plurality of concentrically disposed first and second conduits 80 and 90 will be subject to flow of the second fluid across the outer wall surface of the first conduits 80 and through the interior surface of the second conduits 90 in a second or counter direction along the entire length of the first conduits 80.

According to the teachings of the present invention, any number of concentrically disposed pairs of first and second conduits 80 and 90 may be utilized to provide the desired heat exchange capacity for the heat exchanger 10.

Thus, there has been disclosed herein a unique heat exchanger which provides highly efficient heat transfer between two different temperature fluids. The heat exchanger of the present invention is constructed such that a first fluid is exposed to counter flow of a second fluid along both sides thereof for maximum heat transfer between the two fluids. In addition, the construction of the heat exchanger of the present invention may be varied to suit a wide variety of heating or cooling applications as well as constructed in different sizes to provide the desired amount of heat transfer capability.

What is claimed is:

1. A heat exchanger for exchanging heat between first and second fluids having different temperatures comprising:

a sealed housing;

a first inlet and a first outlet formed in the housing;

a first conduit disposed within the housing;

a second conduit concentrically disposed within and spaced from the first conduit to define a first flow path between the wall surfaces of the first and second conduits, the first flow path being disposed in fluid flow communication with the first inlet and the first outlet for flow of the first fluid in a first direction through the housing between the first inlet and the first outlet;

a second inlet and second outlet formed in the housing; and means, including first and second serially connected portions, for forming a second flow path between the second inlet and the second outlet for flow of the second fluid through the housing in a second direction opposed to the first flow direction of the first fluid, the first portion of the second flow path being across the exterior surface of the first conduit and the second portion of the second flow path being through the second conduit, the means for forming the second flow path including:

first means, disposed in the housing, for directing flow of the second fluid across the exterior wall surface of the first conduit in the second direction; and a third conduit disposed externally from the housing, the third conduit having a third inlet disposed in fluid flow communication with the first means for directing the second fluid flow and a third outlet disposed in fluid flow communication with one end of the second conduit for directing flow of the second fluid from the first means for directing second fluid flow to the one end of the second conduit.

2. A heat exchanger for exchanging heat between first and second fluids having different temperatures comprising:

a sealed housing;

a first inlet and a first outlet formed in the housing;

a first conduit disposed with the housing;

a second conduit concentrically disposed within and spaced from the first conduit to define a first flow path between the wall surfaces of the first and second conduits, the first flow path being disposed in fluid flow communication with the first inlet and the first outlet for flow of the first fluid in a first direction through the housing between the first inlet and the first outlet;

a second inlet and second outlet formed in the housing; and means, including first and second serially connected portions, for forming a second flow path between the second inlet and the second outlet for flow of the second fluid through the housing in a second direction opposed to the first flow direction of the first fluid, the first portion of the second flow path being across the exterior surface of the first conduit and the second portion of the second flow path being through the second conduit, the means for forming the second flow path including:

a first chamber formed in the housing surrounding the first conduit, the first chamber forming the first portion of the second flow path and including a first pair of spaced wall members disposed within and secured to the housing, each having an aperture formed therein, the apertures being co-axially aligned for receiving and supporting the first conduit therebetween; and a third conduit having a third inlet disposed in fluid flow communication with the first means for directing second fluid flow and a third outlet disposed in fluid flow communication with the one end of the second conduit for directing flow of the second fluid from the first means for directing second fluid flow to the one end of the second conduit;

the first and third inlets being positioned at opposed ends of the first chamber for fluid flow of the second fluid therebetween in a direction opposite to the direction of first fluid flow through the first flow path.

3. The heat exchanger of claim 2 further including:

the housing having opposed ends;

a second pair of wall members, each secured to the housing and spaced between one of the first wall members and an end of the housing and forming opposed second and third end chambers in the housing;

each of the second pair of wall members having an aperture formed therein, the apertures being co-axially aligned for receiving and supporting the second conduit therebetween;

the second and third outlets being disposed in fluid flow communication with the second and third end chambers, respectively;

the second conduit being disposed in fluid flow communication with the second and third end chambers for fluid flow of the second fluid in a second direction through the second conduit opposite to the direction of first fluid flow.

4. The heat exchanger of claims 1 or 2 further including:

a plurality of spaced, concentrically disposed pairs of first and second conduits;

each pair of first and second conduits defining a first flow path for the first fluid therebetween.

5. A heat exchanger for exchanging heat between first and second fluids having different temperatures comprising:

a sealed housing having opposed ends and a side wall;

a first conduit concentrically disposed within the housing;

a first pair of spaced wall members disposed within and sealingly secured to the side wall of the housing, each of the first pair of wall members having an aperture formed therein, the apertures being co-axially aligned and receiving the first conduit therethrough in a sealing manner, the ends of the first conduit extending through the first pair of wall members;

the first pair of wall members forming a first sealed chamber within the housing;

a second conduit concentrically disposed within and spaced from the first conduit to define a first flow path between the wall surfaces of the first and second conduits, the second conduit having a longer length than the first conduit;

a second pair of wall members disposed within and sealingly secured to the side wall of the housing, each of the second pair of wall members being spaced from and disposed between second and third end chambers between respective ones of the second wall members and opposed ends of the housing, fourth and fifth chambers being formed between respective ones of the first and second wall members;

each of the second wall members having an aperture formed therein, the apertures being co-axially aligned and receiving the second conduit therethrough in sealing manner, the ends of the second conduit extending through the second wall members and disposed in fluid flow communication with the second and third end chambers in the housing;

a first inlet and a first outlet formed in the side wall of the housing and disposed in fluid flow communication with the fourth and fifth chambers and the first flow path for flow of the first fluid in a first direction through the housing between the first inlet and the first outlet;

a second inlet and a second outlet formed in the side wall of the housing, the second inlet being disposed in fluid flow communication with the first chamber and the second outlet being disposed in fluid flow communication with the third end chamber;

a third inlet and a third outlet formed in the side wall of the housing, the third inlet disposed in fluid flow communication with the first chamber and spaced from the second inlet to form a flow path from the second inlet to the third inlet across the exterior surface of the first conduit for flow of the second fluid in a direction opposed to the direction of flow of the first fluid through the first flow path;

the third outlet being disposed in fluid flow communication with the second end chamber in the housing; and a third conduit disposed externally from the housing and interconnecting the third inlet and third outlet for directing the second chamber such that the second fluid flows through the second conduit in a direction opposed to the direction of first fluid flow through the first flow path.

* * * * *